US006305492B1

(12) United States Patent
Oleiko et al.

(10) Patent No.: US 6,305,492 B1
(45) Date of Patent: Oct. 23, 2001

(54) NOISE-PROTECTION WALL-SEGMENT

(75) Inventors: Bernd Oleiko, Wachtberg Pech; Norbert Brand, Darmstadt; Klaus Oberlander, Hanau, all of (DE)

(73) Assignee: Rohm Gesellschaft mit beschrankter Haftung, Darmstadt (DE)

( * ) Notice: Subject to any disclaimer, the term of this patent is extended or adjusted under 35 U.S.C. 154(b) by 0 days.

(21) Appl. No.: 09/506,220

(22) Filed: Feb. 17, 2000

(30) Foreign Application Priority Data

Feb. 19, 1999 (DE) ..... 199 06 989

(51) Int. Cl.[7] ..... G10K 11/04
(52) U.S. Cl. ..... 181/210; 52/144
(58) Field of Search ..... 181/210, 284, 181/286, 287, 288, 289, 294, 295; 52/144, 145

(56) References Cited

U.S. PATENT DOCUMENTS 4,142,468 * 3/1979 Birntiel ..... 181/210
4,214,411 * 7/1980 Pickeet ..... 181/210
4,226,299 * 10/1980 Hansen ..... 181/210
4,330,046 * 5/1982 Lerner et al. ..... 181/210
5,741,369 * 4/1998 Yamamura et al. ..... 181/210
6,006,858 * 12/1999 Shima et al. ..... 181/210

FOREIGN PATENT DOCUMENTS 27 43 980 4/1979 (DE) .
0384 996 9/1990 (EP) .
0 392 923 10/1990 (EP) .
WO 97/46370 12/1997 (WO) .

* cited by examiner

*Primary Examiner*—Khanh Dang
(74) *Attorney, Agent, or Firm*—Oblon, Spivak, McClelland, Maier & Neustadt, P.C.

(57) ABSTRACT

The invention relates to a noise-protection wall-segment, for example for roads, motorways or railways and such like, said noise-protection wall-segment including transparent sheets, preferably a transparent plastic sheets, and means fixing the sheets. The transparent sheet is shaped around a perpendicular to the installation surface of the assembled noise-protection wall, the term 'shaping' being understood to mean vaulting and/or folding. Moreover, in the case of plastic sheets, preferably made of acrylic glass, threads of synthetic material can be embedded in the sheet which counteract splintering in the event of fracture and constitute a recognized bird impact protection device.

28 Claims, 5 Drawing Sheets

NOISE-PROTECTION WALL-SEGMENT

FIELD OF THE INVENTION

The invention relates to a noise-protection wall-segment, for example for roads, motorways or railways and such, said noise-protection wall-segment consisting of one or more transparent sheets, preferably made of synthetic material, and means for fixing the transparent sheets.;

DISCUSSION OF THE BACKGROUND

Noise-protection embankments, walls or facades have been employed for some years in connection with the protection of citizens from traffic noise. On account of the large space requirement of embankments, these are preferably raised in open terrain; on the other hand, in the municipal domain, in the case of bridge structures and frequently also in the case of railway lines, noise-protection walls or facades find application.

In order not to exclude the car-driver or the passenger of a rail vehicle entirely from the environment despite the high walls—that is, as a precaution against a possible "tunnel effect" on bridges, for example—these walls are nowadays constructed so as to be partially transparent.

Stemming from the conventional technology for installing silicate glasses, transparent panes are set in frames, and in certain cases wire gratings are additionally intended to provide a safeguard by preventing fragments from falling down.

A generic noise-protection wall-segment, is known from DE 42 30 786 A1, for example. The segment that is presented therein consists of two perpendicular posts at the edges and a substantially rectangular frame which is fixed to the perpendicular posts at the edges and of a substantially rectangular sound-absorbing sheet. The frame exhibits two vertical frame crossbeams and an anterior stiffening crossbeam connecting the two upper end regions of the two vertical frame crossbeams and in contact with the latter, which likewise connects the two upper end regions of the two vertical frame crossbeams, being in contact with the latter, and which is attached in such a way as to be capable of being dismantled. The substantially rectangular sound-absorbing sheet is dimensioned so as to be capable of being inserted into the frame and is detachably retained in the latter.

From the dimensional design it is to be noted that the sound-absorbing sheet made of plastic which is inserted into the frame may be up to 50% higher than the frame or than the vertical frame crossbeams, so that for a given segment-height the frame has to have a height amounting to approximately ⅔ of the height of the sound-absorbing sheet.

Although the noise-protection wall-segments according to DE 42 30 786 enable the advantageous use of transparent plastic sheets, as a result of the essential use of the frame construction at approximately ⅔ of the height of the sound-absorbing sheets a visually "quite massive" impression is still conveyed. This is because the "free-standing portion", that is to say the part of the plastic sheets projecting beyond the frame construction, is important for the visual impression.

Moreover, in this way a relatively large proportion of the area of the relatively expensive plastic sheet is employed without achieving the desired effect, i.e. a large fraction of the plastic sheet is totally contained within the frame of the load-bearing structure, so that the intended slimmer effect is achieved only imperfectly or not at all.

SUMMARY OF THE INVENTION

In view of the state of the art which has been mentioned and discussed herein, the object underlying the invention is accordingly to make available a noise-protection wall-segment of the aforementioned type which is intended to convey a "visually lighter" impression but at the same time is sufficiently stable in relation to loads due to wind pressure.

Inter alia, visually intrusive posts or frame constructions are to be reduced to a minimum or even entirely avoided with the new noise-protection wall-segment.

In particular, one aim of the invention is to make available a noise-protection wall-segment, dispensing with bars or frames that are arranged high up and that therefore have a disadvantageous influence on the visual and aesthetic effect, that is to permit the erection of a noise-protection wall that is as imperceptible as possible and harmoniously adapted to the landscape.

Furthermore, the new noise-protection wall-segment is to be capable of being prefabricated industrially, and the prefabricated segments are to be capable of being easily transported, capable of being assembled and disassembled, and also capable of being interchanged as simply as possible.

Another object underlying the invention can be seen in the feature that the noise-protection wall-segments are to be capable of being secured with simple means against splintering in the event of fracture, in which connection they are, in addition, also to be capable of being formed so as to prevent collisions with flying birds.

Moreover, the creation of a noise-protection wall by making use of noise-protection wall-segments is also an object of the invention, in which connection the new noise-protection wall is to be transparent, visually as inconspicuous as possible and barely perceptible. In particular, the new noise-protection wall is also to be simple to fabricate, easy to repair and favourable as regards maintenance.

These objects, as well as others which are not stated individually but which readily follow from the introductory discussion or which can be derived from what has been said herein, are achieved by means of a noise-protection wall-segment.

These objects, as well as others which are not stated individually but which readily follow from the introductory discussion or which can be derived from what has been said herein, are achieved by means of a noise-protection wall-segment having the features of claim 1. Advantageous embodiments of noise-protection wall-segments according to the invention are afforded protection in the subordinate claims that are dependent on claim 1. Further claims relate to noise-protection walls that can be obtained from the segments according to the invention. With regard to the problematical nature of the process, the corresponding process claims provide solutions for the problems underlying the invention. Advantageous modifications to the process are subjects of the subordinate claims that refer to the independent process claims.

In the case of a noise-protection wall-segment exhibiting a transparent sheet and means fixing the transparent sheet, by virtue of the fact that the sheet, relative to its arrangement in an assembled noise-protection wall, is shaped around a vertical line out of the plane of the wall defined by the noise-protection wall, it is possible, in a manner that could not readily be foreseen or predicted by the average technically skilled person, to obtain a whole series of advantages. These include, inter alia:

In the case where the noise-protection wall-segment according to the invention is employed in a noise-protection wall, no retaining posts and/or load-bearing members of any kind are necessary between the individual segments.

The noise-protection wall-segments according to the invention consequently permit, for the first time, the provision of transparent noise-protection walls having "transparent posts", i.e. for the first time it is possible to provide a completely transparent noise-protection wall without non-transparent posts that interfere with the visual impression, and to realise intervals of six, eight or more metres between non-transparent posts.

The noise-protection wall-segments are self-supporting.

The noise-protection wall-segments are stable in relation to atmospheric influences, loads arising due to wind pressure, in relation to vandalism or other stress demands as defined by ZTV LSW 88, for example.

The shaping of the individual segments around a vertical line relative to the direction of installation of the wall (vaulting and/or folding) generates a larger standing area on the ground and is suitable to conduct away induced loads due to wind pressure into pedestals or foundations.

In instances of vaulted shaping, noise-protection wall-segments according to the invention exhibit a static depth of sufficient magnitude.

In instances of folded shaping, i.e. cases of more strongly bevelled edges with larger angles, noise-protection wall-segments according to the invention exhibit high stability and high suitability for use.

Vaulting and folding can be simply combined, according to the invention, in one and the same noise-protection wall-segment, resulting in a further improvement in the stability and in the suitability for use.

A noise-protection wall that exhibits noise-protection wall-segments according to the invention or that consists thereof can be kept transparent over its entire length and height. In this way the so-called tunnel effect is avoided, i.e. the transport user such as a passenger in a rail vehicle or a car-driver, for example, is not excluded from his/her environment.

Fitting of segments according to the invention into a wall is possible subject to prestressing of individual segments or all segments, so that the individual segments are supported against one another in the completed wall. The shaping, preferably the vaulting, of the individual segments accordingly results in a simpler installation of the noise-protection wall, as well as an associated cost saving.

Noise-protection wall-segments according to the invention can be combined simply and easily with sheets or segments from the state of the art so as to form a noise-protection wall.

The segment according to the invention exhibits a transparent sheet that is shaped around a vertical line. In this connection the vertical line corresponds to a perpendicular to the subsequent installation surface of the assembled noise-protection wall.

The "shaping" which has been mentioned is to be understood to mean, for example, a vaulting or several instances of vaulting, a folding or several instances of folding, as well as a combination of one or more instances of vaulting with one or more instances of folding.

"Vaulting" means, for example, a curvature of the segment or even a bowl-type shaping or design in the vertical direction of the segment. It is possible for the instances of vaulting to be described by relatively large radii relative to the thickness of the transparent sheet of the segment.

"Folding" means, for example, a kink in the vertical direction of the segment that is capable of being described by a relatively small radius in relation to the thickness of the sheet or even—depending on the production variant—by an angle.

Both with respect to vaulting and with respect to folding it holds true that the corresponding shaping does not have to extend over the entire length and/or height of the noise-protection wall-segment, but rather that such a shaping relative to length and/or height may also be present only in sections. In this connection it is advantageous for a vaulting or folding to be formed merely in one region of the segment, whereas other constituent regions of the segment correspond to the sheet-like and therefore substantially plane segments known from the state of the art.

An advantageous configuration of the noise-protection wall-segment according to the invention provides that the sheet is shaped, i.e. vaulted and/or folded, in such a way that loads arising, in particular loads due to wind pressure, are capable of being accommodated and capable of being conducted away into pedestals and/or foundations without the use of posts, supporting members or load-bearing members arranged between two segments. In particular, the design of the transparent part of the segment according to the invention makes it possible in this connection that a noise-protection wall constructed from appropriate segments requires no posts, supporting members or load-bearing members between the individual segments. This is achieved by the shaping, i.e. the vaulting and/or folding out of the plane of the wall, being suitable to undertake the supporting function of a post, for example.

It is possible for the shaping of the transparent sheet of the noise-protection wall-segment to be described quite simply by the cross-sectional profile of the sheet. In a particularly expedient manner the sheet of the segment of the invention is shaped in such a way around the perpendicular to the installation surface of the segment in a noise-protection wall that it is possible for the cross-sectional profile of the transparent sheet of the segment to be partially described by radii of curvature or angles between sections or over the entire contour thereof by one or more radii of curvature. The transparent sheet may consequently exhibit several curvatures and/or kinks, it also being possible for regions to be situated between these curvatures or kinks that correspond in their shape to the sheet-like segments known from the state of the art. Moreover, there is the advantageous possibility that the transparent sheet of the segment is continuously curved and exhibit no kinks whatsoever. A sheet is also possible that is provided, in part, with kinks or folds and that exhibits no curvature capable of being described by radii of curvature.

A special embodiment of the noise-protection wall-segment of the invention dispenses totally with kinks or folds and merely provides a vaulting of the sheet in the form of a curvature. This curvature can be described on the basis of only one radius of curvature, i.e. the curvature of the cross-sectional profile is substantially constant over the entire length of the segment. The cross-sectional profile of the transparent sheet consequently has a contour that corresponds to the portion of a circular circumference, the circle of which has the radius of curvature as its radius.

Another expedient modification of the noise-protection wall-segment according to the invention relates to transparent sheets that exhibit curvatures or kinks in only two regions. The stated regions are provided in each instance in the vicinity of the left or right edge of the segment. The respective distances to the right and left edges may be the same, but this is not absolutely essential. With such a design the segment comprises three sections, which may be designated as the left, right and central sections. Within these sections no other curvature or kink is present; rather these segments correspond to the sheet-like segments known from the state of the art. The right and left sections are suitable to undertake the function of a post or such like, i.e. the loads applied are conducted via said sections into the foundation. The angle between the right or left section and the central section of the segment can be freely chosen in each case but advantageously lies between <180° and 90°. Angles below 90° are also possible but are less preferred.

In another advantageous configuration of the noise-protection wall-segment according to the invention the transparent sheet exhibits folds in two regions in the form of curvatures or kinks that are provided in each instance in the vicinity of the left or right edge of the segment. The respective distances to the right and left edges may be the same, but this is not absolutely essential. With such a design the segment comprises three sections, which may be designated as the left, right and central sections. In contrast with the embodiment mentioned previously, the central section likewise exhibits a shaping, namely preferably a vaulting, that is characterized by a curvature of said central section. This curvature may be constant over the entire length of the central section, i.e. it is possible for it to be described by only one radius of curvature (first case), or it may vary (second case).

In the first case the cross-sectional profile of the central section of the plastic sheet consequently has a contour that corresponds to the portion of a circumference of a circle, the radius of which is equal to the radius of curvature in the central section. This radius of curvature can be substantially freely chosen over wide ranges, but in practice, depending on the production process and depending on the thickness of the sheets employed, especially in the case of plastic sheets, particularly of acrylic glass, a radius that does not fall below two hundred times the thickness has proved to be particularly expedient. To the extent that acrylic glass is employed by way of transparent material for the sheet, the radius is preferably larger than or equal to three hundred times the thickness of the sheet.

Particularly in connection with plastic sheets and in the case of radii that are generated by cold inward bending of sheets, tensile stresses arise on the outside of the radius and compressive stresses arise on the inside of the radius in the course of prestressing. Above all in the case of bending radii that do not fall below two to three hundred times the thickness of the sheet, the tensile stresses arising on the outside of the sheet do not exceed the maximum permissible stresses in the plastic sheet for continuous use.

Essentially there are no restrictions in the direction of larger radii, but in the preferred case an enlargement of the standing area of the shaped segment, in particular of the vaulted segment, should still be guaranteed.

In the case of a sheet that is approximately 20 mm thick and made of acrylic glass for the middle section of the sheet, particularly favourable radii lie within the range from $6\times10^3$ mm to $12\times10^3$ mm.

In the second case the radius of curvature may vary over the entire length of the central section, including the possibility that individual regions of the central section exhibit no radius of curvature but correspond to non-curved sheets.

In both cases the angle between the right or left section and the central section of the segment can be freely chosen in each case but advantageously lies between <180° and 45°, expediently between 135° and 60° and, in quite particularly advantageous manner, between 120° and 75°.

The sheet of the noise-protection wall-segment entering into consideration in accordance with the invention has to be transparent. In principle, glasses or glass-like materials come into consideration for this purpose. Glasses are to be understood to be, generally, substances in the amorphous, non-crystalline solid state. In the narrower sense according to the invention, inorganic or organic glasses are useable above all.

In the case of the inorganic glasses it is mostly a question of oxidic products of fusion that are converted into the solid state by a freezing process without crystallization of the melt-phase components.

In this connection the temperature of the freezing process is used with a view to characterizing the glasses and manifests itself, for example, as a change in the thermal expansion in the course of the cooling or heating of a glass. Within the scope of the invention, the temperature at which this change occurs is designated as the glass temperature or transformation temperature Tg.

Technical glasses play a special role amongst the inorganic glasses that are possible for the invention. This technical glass preferably consists of cooled melts of silicon dioxide ($SiO_2$), calcium oxide (CaO), sodium oxide ($Na_2O$) with, in part, relatively large amounts of boron trioxide ($B_2O_3$), aluminium oxide ($Al_2O_3$), lead oxide (PbO), magnesium oxide (MgO), barium oxide (BaO), potassium oxide ($K_2O$) and other additives.

Far more preferred for the invention than the inorganic glasses that have been mentioned (that is, above all, the siliceous glasses) are organic glasses. In this connection it is a question of amorphous plastics which, by reason of particular optical properties (transmission, refractive index, dispersion, optical homogeneity), can advantageously replace inorganic glass. In the case of polymers of this type it is a question, in particular, of thermoplastics, but thermosetting plastics, for example those based on epoxy resin, are suitable in principle for use as glasses.

The most important organic glasses for the shaping of sheets of the segments according to the invention are polymethyl methacrylates ("acrylic glass"), polycarbonates, polyvinyl chloride, polystyrenes and similar substances.

Particularly preferred transparent synthetic materials include, inter alia, poly(meth)acrylates, polycarbonates, polyvinyl chloride and also mixtures of these synthetic materials.

In an advantageous embodiment of the noise-protection wall-segment according to the invention the plastic sheet consists of acrylic glass. In comparison with other organic glasses, acrylic glass is particularly suitable for use as the transparent part of a noise-protection wall-segment according to the invention, since it is distinguished by high light transmission, transparency, scratch resistance, high stiffness and high modulus of elasticity and consequently, besides its resistance to light and resistance to weathering, complies with the essential requirements as regards the transparent part of the segment according to the invention.

An acrylic-glass sheet of a noise-protection wall-segment according to the invention preferably exhibits threads, gratings or grids made of polyamide, polypropylene or another plastic that is incompatible with the plastic of the matrix.

In another expedient configuration of the invention, monofilament threads of polyamide are embedded in the plastic sheet of the segment.

The embedded polyamide threads are distinguished by high strength and are arranged parallel to one another with a certain spacing which follows from the size of the splinters arising in the event of fracture of such a pane of acrylic glass. The orientation of the rectilinearly extending threads can be freely chosen, though an orientation perpendicular to the installation surface is recommended. In principle, however, an arrangement of the threads would also be conceivable in which the threads intersect by reason of two orientations and in which a grid or a grating is consequently formed. In the event of a fracture, the high-strength threads counteract the formation of free splinters, i.e. the occurrence of dangerous fragments is avoided. Additional catching devices are therefore unnecessary, resulting in a more cost-effective structure. Moreover, by virtue of a high-contrast design of the polyamide threads in relation to their environment, flying birds can be prevented from colliding with the noise-protection wall.

Noise-protection wall-segments according to the invention are provided with fixing means in addition to a transparent sheet. Said fixing means serve for the installation and arrangement of the segments and for the formation of walls that exhibit segments according to the invention and/or for the fastening of the transparent sheets to prepared receptacles, foundations, pedestals, bored piles, driven piles or other foundation measures. In particular, the fixing means themselves also comprise pedestals, frames, bars, crossbeams, attachments in the form of screwed connections, tensioning wires and such like.

As a result of coordinating the transparent sheet and the fixing, or more precisely, fastening means, within the scope of the invention it is guaranteed in advantageous and therefore particularly expedient manner that fastening measures such as pedestals or foundations clamp or fix only subsidiary sections of a lower section of a transparent sheet close to the ground. However, bracing arrangements with wires over the entire height of the segments are also possible, so long as the use thereof does not have a disadvantageous influence on the visual effect.

In a preferred configuration the segment of the invention is characterized in that the fixing means are concrete moldings which exhibit prepared receptacles in the form of depressions, channels, grooves, bores or such like for the fastening of the sheets. In addition, the sheets can be fastened with bolts or screws.

The concrete moldings that can be employed as a fixing and/or clamping means may consist of concrete known as such, wood-fiber concrete or polymer concrete. Polymer concrete is preferred. This is a designation for a material consisting of concrete, in which, with a view to improving the processing properties and/or usage properties, the hydraulic binding agent is entirely or partially replaced by concrete additives based on synthetic resins, in particular based on reaction resins (reaction-resin concrete). Polymer concrete possesses high tensile and compression strengths and exhibits strong resistance to chemical corrosion and frost. The polymer binder can be admixed to the mixture in the form of a single binder, for example epoxy concrete, or it can be added together with water, as in polymer-cement concrete.

Within the scope of the invention, in a particular variant a pedestal made of concrete, polymer concrete or wood-fiber concrete, preferably polymer concrete, is accordingly provided that is adapted to the shape of the sheet and that, for instance, exhibits a height, measured from the foundation, in the range from 0.3 to 1.5 m, expediently 0.5 to 1 m, in particularly preferred manner 0.6 to 0.8 m. The pedestal of the noise-protection wall-segment exhibits channel-like depressions, grooves or receptacles that are prepared for the reception of a section of the transparent sheet close to the pedestal. In this way approximately 10 to 30 cm of the transparent sheet can be wedged or clamped into the pedestal and screw-coupled together with the pedestal or fixed in some other way. In an expedient manner the transparent sheet is consequently clamped into the concrete pedestal and fixed.

The noise-protection wall-segment consisting of transparent sheet and pedestal can then be easily anchored in the ground. To this end, pile foundations at relatively large intervals of approximately 6 to 12 m suffice on a free stretch in the case of noise-protection wall-segments with plastic sheets that cover a length of approximately 3 m.

Noise-protection wall-segments according to the invention can be combined in principle with noise-protection elements not pertaining to the invention. Moreover, the segments according to the invention which have been described can be modified still further with certain intermediate parts or elements that permit transparent posts to be created.

The claimed noise-protection wall, in which the noise-protection wall-segments that have been described find application, is distinguished in particular by its simple structure.

Said wall exhibits one or more segments. The segments are constructed along an installation line in such a manner that, in each instance, the left side of the one segment borders the right side of the other segment. The terms right and left side are to be understood to mean the extreme right and left extents, respectively, i.e. by reason of the various forms of design of the segments it does not necessarily have to be a question of the right or left edge of the transparent sheet. Both fastening means and retaining posts are dispensed with between the individual segments, and merely at the sides of the first and last segments is a retaining post and/or load-bearing member provided in each instance. Between these two retaining posts and/or load-bearing members an installation line is provided, along which the segments are aligned. The length of the installation line is preferably shorter than the total length of the directly aligned segments that are to be used, so that the latter can be favourably fitted in prestressed form. By reason of the prestressing, the segments that are employed press against one another with their sides and stabilize the noise-protection wall. Optionally, the sides can be distanced and screwed to one another or fastened otherwise. The retaining posts and/or load-bearing members at the two ends of the noise-protection wall accommodate the load.

Several noise-protection wall-segments can be reciprocally supported in the case where they are arranged to form a noise-protection wall; with a view to further stabilization at the beginning and at the end of a wall or of a desired section, boundary posts may be provided.

In the case of an assembled noise-protection wall the pedestals may preferably be in contact with one another by forced closure.

Preferred variants of noise-protection walls according to the invention relate, inter alia, to those embodiments in which, in each instance, two segments are connected by fastening means in such a manner that these two segments form a retaining post which stands between adjacent segments of the noise-protection wall and is connected to said segments via fastening means. This enables a modification of the transparent post.

In addition, it is expedient if the segments that form the retaining post exhibit a cross-sectional profile that exhibits a curvature or a kink in only one region, so that the cross-sectional profile comprises a right section and a left section. In this case an angle between <180° and 90° preferably exists between the right section and the left section. It is particularly expedient for the angle between the right section and the left section to amount to 90°, the segments between the retaining posts being non-curved, flat sheets.

Besides this, a noise-protection wall is also pertinent to the invention in which segments according to the invention are arranged one above the other in two or more rows, either on their own or in combination with transparent sheets or segments that do not accord to the invention. A row of segments close to the ground may in this case exhibit at least one noise-protection wall-segment according to the invention, whereas a row of transparent sheets laid thereon can be fastened thereto.

The noise-protection elements or segments according to the invention can be produced in various ways. Depending on whether the transparent sheet is fabricated from inorganic or organic glass, differing or similar variants enter into consideration. In general, however, the procedure is such that the transparent part is shaped and then combined with fixing means.

Of particular interest for the invention are, inter alia, production processes that relate to transparent sheets manufactured from organic glasses.

In this case, discontinuous as well as continuous process enter into consideration for production of the sheets, the transparent sheets for the segments of the invention preferably being capable of being obtained in two shaping steps.

Particularly preferred production processes for plastic sheets, in particular acrylic-glass sheets, are the so-called chamber process, or more precisely the variant thereof known as the Rostero process (see Ullmann, $_5^{th}$ Edition, entry headed "Casting of Acrylic Glass"), the water-bath process or polymerisation in an autoclave.

These processes are especially suitable within the scope of the invention for the production of sheet-like plastic articles from polymerizable compositions.

In this context, polymerizable compositions are preferably compounds that exhibit ethylenically unsaturated monomers and/or prepolymerised monomers (syrups). These compounds preferably exhibit monomers or syrups that are suitable for the production of so-called organic glasses or synthetic glasses.

The aforementioned ethylenically unsaturated monomers which may be contained in the polymerisable compositions include, inter alia, vinyl esters, esters of acrylic acid, for example methyl acrylate and ethyl acrylate, esters of methacrylic acid, for example methyl methacrylate, ethyl methacrylate, butyl methacrylate and ethylhexyl methacrylate, vinyl chloride, vinylidene chloride, vinyl acetate, styrene, substituted styrenes with an alkyl substituent in the side chain, such as, for example, α-methylstyrene and α-ethylstyrene, substituted styrenes with an alkyl substituent on the ring, such as, for example, vinyltoluene and p-methylstyrene, halogenated styrenes such as, for example, monochlorostyrenes, dichlorostyrenes, tribromostyrenes and tetrabromostyrenes, vinyl and isoproprenyl ethers, derivatives of maleic acid, such as, for example, maleic anhydride, methylmaleic anhydride, maleimide, methyl maleimide, and dienes, such as, for example, 1,3-butadiene and divinylbenzene; preferred are acrylic esters, methacrylic esters, vinyl acetate, vinyl chloride, vinylidene chloride, styrene, α-methylstyrene, halogen-substituted styrenes, vinyl ethers, isoprenyl ethers and dienes; methyl methacrylate is quite particularly preferred.

Quite particularly preferred embodiments are distinguished in that, by way of polymerisable composition, a resin containing (meth)acrylate having the composition

| | |
|---|---|
| (meth)acrylate (A) | 20–99.9 wt. % |
| comonomers (B) | 0–79.9 wt. % |
| polymers (C) soluble in (A) or (B) | 0.1–70.0 wt. % |
| and, relative to 100 parts of components (A)–(C), | |
| initiators (D) | 0.1–5 parts by wt. |
| conventional processing aids (E) | 0–10 parts by wt. |
| is employed. | |

(Meth)acrylate designates acrylic and/or methacrylic compounds such as were named previously by way of examples. Comonomers are compounds that are capable of being copolymerized with (meth)acrylates. These include, inter alia, the aforementioned monomers that are not (meth) acrylate. Polymers that may be dissolved in the polymerizable composition are, for example, polymerizates or copolymerizates of the aforementioned monomeric constituents. Initiators and processing aids are described below.

The aforementioned monomers may also be employed as mixtures, as well as in prepolymerized form, as so-called syrups.

All the aforementioned monomers are commercially available. But they can also be produced in any manner known to a person skilled in the art.

The polymerizable compositions may contain the conventional additives. By way of examples, the following additive substances may be mentioned: antistatic agents, antioxidants, mold-release agents, flameproofing agents, lubricants, dyestuffs, flow-improving agents, fillers, light stabilizers and organic phosphorus compounds such as phosphites or phosphonates, pigments, anti-weathering agents and plasticizers.;

The additive substances are employed in conventional quantities, i.e. up to 80 wt. %, preferably up to 30 wt. %, relative to the total mass. If the quantity is greater than 80 wt. %, relative to the total mass, properties of the polymerizable mass such as the processability, for example, may be impaired.

The molds that are employed in the chamber process or Rostero process generally exhibit, at least partially, an inner surface consisting of inorganic glass.

The term "mold" in this context is to be understood to mean all molds that are used conventionally. This mold may be composed of various parts, with one part of the mold exhibiting a glass surface. The expression "at least partially" asserts that the proportion of the glass surface amounts to at least 10%, preferably more than 30% and, in quite particularly preferred marmer, more than 80%, relative to the total inner surface of the mold.

A preferred mold comprises, for example, two glass plates—a top plate and a bottom plate—which are sealed and separated at the sides with suitable measures, such as tapes or sealing-strip cords, for example. The glass plates may, for example, be held together with metal clips and exhibit, for example, an area of 2 m to 3 m or 2 m to 4 m and a thickness of approximately 2 to 30, preferably 4 to 20 mm. Moreover, so-called multiple chambers, in particular twin chambers, that have a laminated structure are also known, the middle glass plates having contact with the polymerizable composition on both sides.

In the case of the chamber process or Rostero process the polymerizable composition is polymerized after the mold has been filled, a molded body being obtained. The term 'polymerization' in this connection is also to be understood to mean all processes known amongst experts that are carried out in bulk, such as, for instance, bulk polymerization which, by way of example, is described in Houben-Weyl, Volume E20, Part 2 (1987), page 1145 ff.

Polymerization can be carried out radically as well as ionically, radical polymerization being preferred. It can be carried out thermally, by radiation and by initiators, in which case use is preferably made of initiators that form radicals. The respective conditions of polymerization depend on the chosen monomers and on the initiator system and are widely known amongst experts.

The preferred initiators include, inter alia, the generally known azo initiators such as AIBN or 1,1-azobiscyclohexanecarbonitrile, as well as peroxy compounds such as methyl ethyl ketone peroxide, acetyl acetone peroxide, ketone peroxide, methyl isobutyl ketone peroxide, cyclohexanone peroxide, dibenzoyl peroxide, tert. butylperoxybenzoate, tert. butylperoxyisopropyl carbonate, 2,5-bis(2-ethylhexanoylperoxy)-2,5-dimethlhexane, tert. butylperoxy-2-ethylhexanoate, tert. butylperoxy-3,5,5-trimethylhexanoate, 1,1-bis(tert. butylperoxy)cyclohexane, 1,1-bis(tert. butylperoxy)-3,3,5-trimethylcyclohexane, cumyl hydroperoxide, tert. butyl hydroperoxide, dicumyl peroxide, bis(4-tert. butylcyclohexyl)peroxydicarbonate, mixtures of two or more of the aforementioned compounds with one another as well as mixtures of the aforementioned compounds with compounds that have not been mentioned and that may likewise form radicals.

After the molded body has been obtained, the latter is released from the mold, i.e. it is taken out of the mold. This operation is dependent on the mold that is used and is known as such. Release from the mold can be accelerated by external or internal mold-release agents.

In particular, the chamber process is just as suitable as the Rostero process also for the production of sheet-like noise-protection segments made of plastic with internal threads embedded in the surrounding matrix of the plastic and preferably consisting of a different, incompatible synthetic material, which, to a considerable degree, hold fragments together that arise in the event of a fracture. Such panes are disclosed, for example, in EP 0 531 982, the panes that are disclosed in the stated EP exhibiting embedded threads that are, in addition, also rich in contrast and accordingly able to serve for protection against birds in particularly aesthetic manner.

Besides the discontinuous process variants which have bene mentioned hitherto, continuous processes for producing plane sheet elements for noise protection are also conceivable. Accordingly, continuous fabrication of sheets can be made possible by extrusion of molding compositions.

In addition, the production of sheets by the method of co-extrusion is conceivable, wherein strands consisting of a second synthetic material that is incompatible with the first synthetic material of the matrix are co-extruded with the second synthetic material. In this case such strands may also be embedded in the sheet in the form of monofilament threads.

Both in the case of the discontinuous chamber process (or Rostero process) and in the case of continuous extrusion processes, as already mentioned the production of flat sheets or segments is directly followed by at least one further shaping step or joining process, in order to obtain elements having a geometry according to the invention.

One quite expedient variant provides, for example, that at least two flat sheets are joined together, for example by adhesive bonding, an angular element (folded element) being obtained. As a result of this joining it is possible for arbitrary angles to be obtained in simple manner.

A preferred process variant is characterized in that a) a transparent sheet is provided, b) the transparent sheet is shaped in such a manner that the sheet, relative to its arrangement in an assembled noise-protection wall, is vaulted or folded around a vertical line out of the plane of the wall defined by the noise-protection wall, and c) the shaped transparent sheet is provided on the foundation side or pedestal side with fixing and/or clamping means.

Accordingly, sheet-like transparent elements can be deformed in a hot state by reason of their preferably thermoplastic behavior. By this means, larger angles, bends or changes of direction are preferably generated which correspond to relatively small radii. Accordingly, hot-bending radii of approximately 20 to 70 mm, preferably 30 to 50 mm, are possible with a sheet thickness of approximately 20 mm. In addition to this, the possibility of cold deformation also presents itself, whereby prestressed elements or segment s can optionally also be obtained.

A particularly interesting result is obtained if a transparent plastic sheet made of acrylic glass is firstly bent inwards (folded) in the hot state at the two sections of the sheet situated at the edges at temperatures above Tg of the acrylic glass and if the central section is then prestressed (vaulted) in the cold state at temperatures below Tg.

A particularly expedient procedure is implemented by an acrylic-glass sheet approximately 20 mm thick, approximately 2 m high and approximately 4 m wide being bent in the hot state at approximately 5 m and at approximately 3.5 m, related to the width of the sheet, over the entire height of the sheet in the same direction at an angle of, in each instance, approximately 74°, a central section having a width of approximately 3 m being obtained, in that the central section is bent inward in the cold state with a radius of curvature of approximately 6000 mm, the vaulting which has arisen in this way being fixed with clamping tools, and in that the sheet which has been prestressed in this manner is connected to a pedestal made of concrete.

A plurality of segments which have been prestressed in this manner can then be lined up side by side to form a wall, so that the segments are reciprocally supported in substantially lateral manner and are supported against retaining posts at the ends of the wall or at intervals which can be freely chosen. The clamping and retaining elements that are employed for the purpose of prestressing and fixing then have to be removed in situ only in the course of the actual assembly of the noise-protection segments to form the completed noise-protection wall.

BRIEF DESCRIPTION OF THE DRAWINGS

The invention will be described in greater detail in the following description on the basis of examples with reference to the appended Figures wherein.

DESCRIPTION OF THE PREFERRED EMBODIMENTS

Figure 1:
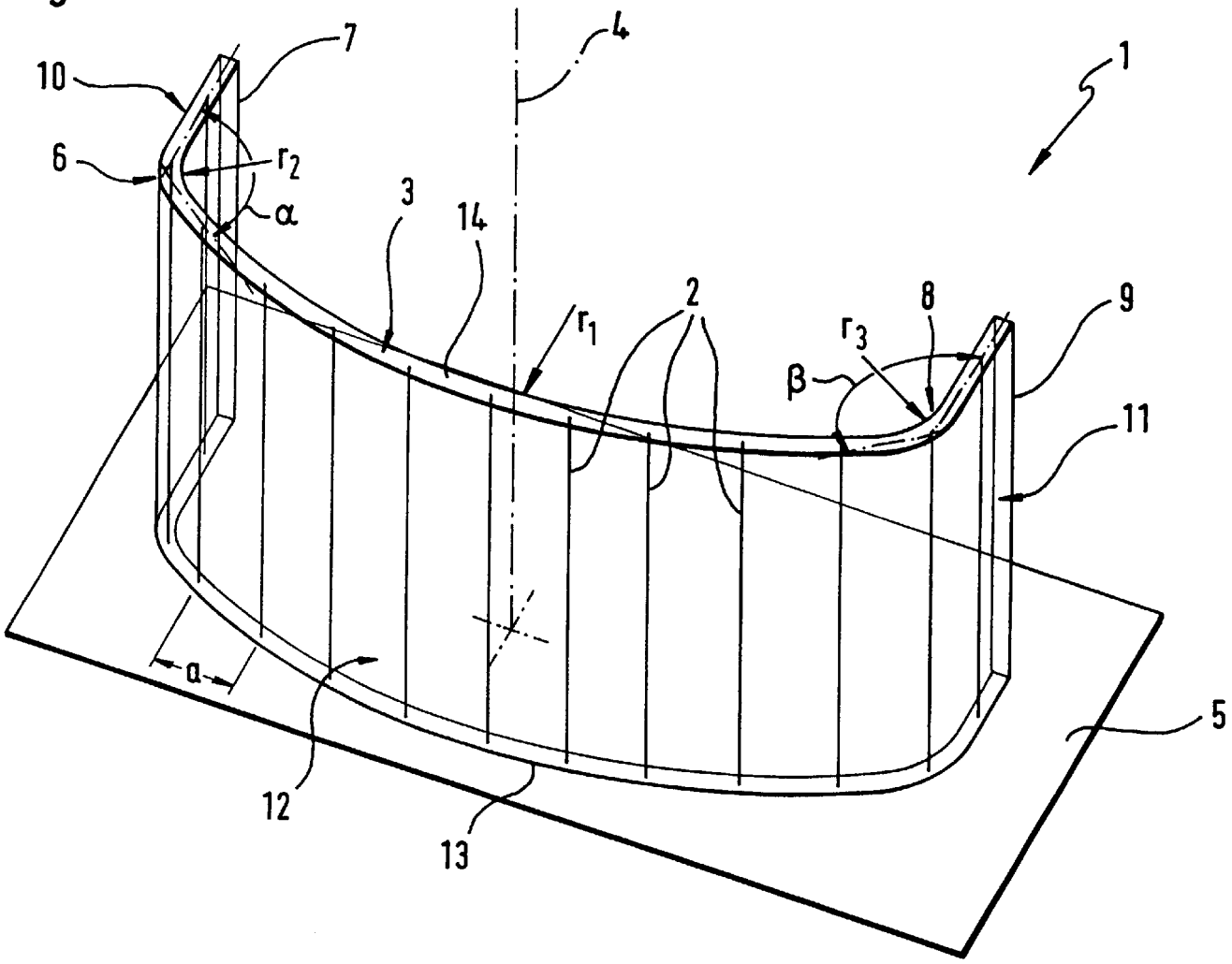
FIG. 1 is a perspective representation of a noise-protection wall-segment with embedded threads.

A noise-protection wall-segment 1 with embedded threads is represented in perspective in FIG. 1 by way of example. The plastic sheet 3 is a vaulted around an axis 4 perpendicular to the installation surface 5 of the segment 1. The plastic sheet 3 exhibits, in addition, a region 6 that is situated in the vicinity of the left edge 7 of the plastic sheet 3, as well as a region 8 that is situated in the vicinity of the right edge 9 of the plastic sheet 3. In both regions 6, 8 the plastic sheet is greatly curved, so that the plastic sheet comprises a left section 10, a right section 11 and a central section 12. Both sections 10, 11 correspond in their shape to a flat, non-curved surface, whereas the central section 12 forms a curved plane with only one radius of curvature $r_1$ over its entire length. The angles $\alpha$ and $\beta$ between the left and the right sections, respectively, and the central section are of equal magnitude but may perfectly well take different values. The values advantageously lie within the range between 180° and 75°. The curvatures in the left region 6 and in the right region 8 can be described with the aid of the radii of curvature $r_2$ and $r_3$, respectively.

The embedded threads 2 extend parallel to one another and perpendicular to the installation surface 5 from the lower edge 13 as far as the upper edge 14 of the noise-protection wall-segment 1. The spacing a between each two adjacent threads results from the splintering behavior of the plastic sheet that is employed. In the case of currently available noise-protection walls the spacing a amounts to approximately 30 mm.

Figure 2:
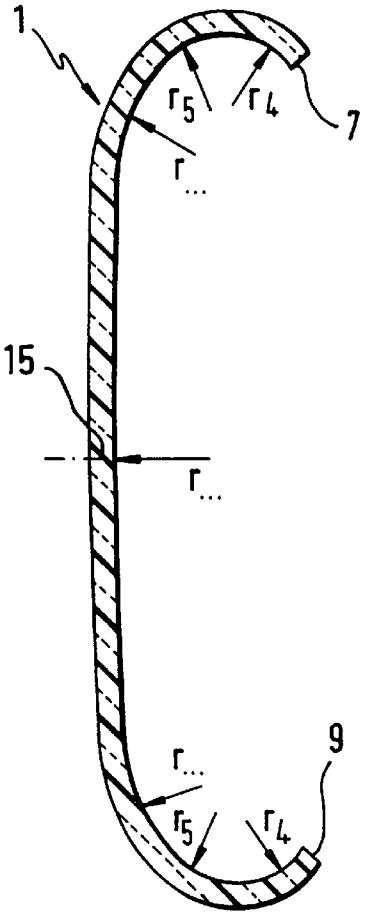
FIG. 2 is a cross-sectional profile of a noise-protection wall-segment that is capable of being described by several radii of curvature over its entire contour.

In FIG. 2 the cross-sectional profile is represented of a noise-protection wall-segment that is provided with several different curvatures over its entire contour. The cross-sectional profile exhibits variable radii of curvature $r_4$, $r_5$, . . . $r_i$ in its overall contour. In the present example the radius of curvature increases, starting from the left edge 7, as far as the middle 15 of the cross-sectional profile and becomes smaller again in the direction of the right edge 9. But such a contour is in no case absolutely essential; in addition, the symmetry that is shown here does not have to obtain.

Figure 3:
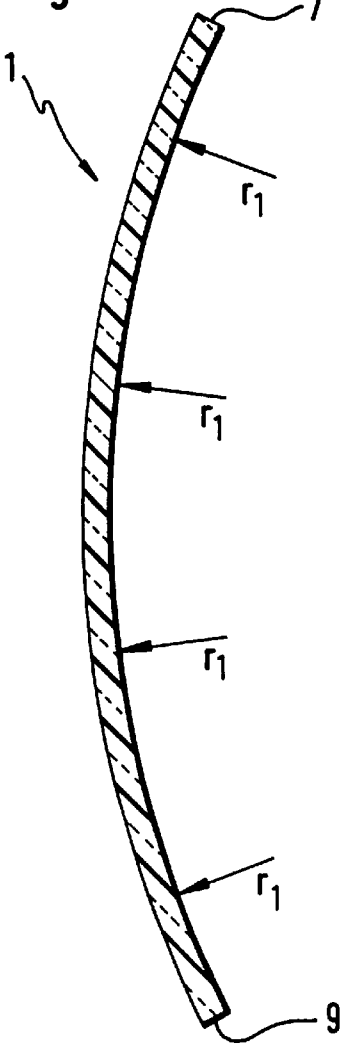
FIG. 3 is a cross-sectional profile of a noise-protection wall-segment that possesses only one radius of curvature over its entire contour.

In FIG. 3 a cross-sectional profile of a noise-protection wall-segment is represented that exhibits only one curvature over its entire contour. In contrast with the profile represented in FIG. 2, it is possible for such a contour of the cross-sectional profile to be described by only one radius of curvature $r_1$. Said contour is identical with a portion of a circular circumference, the circle of which has the radius of curvature $r_1$ as its radius.

Figure 4:
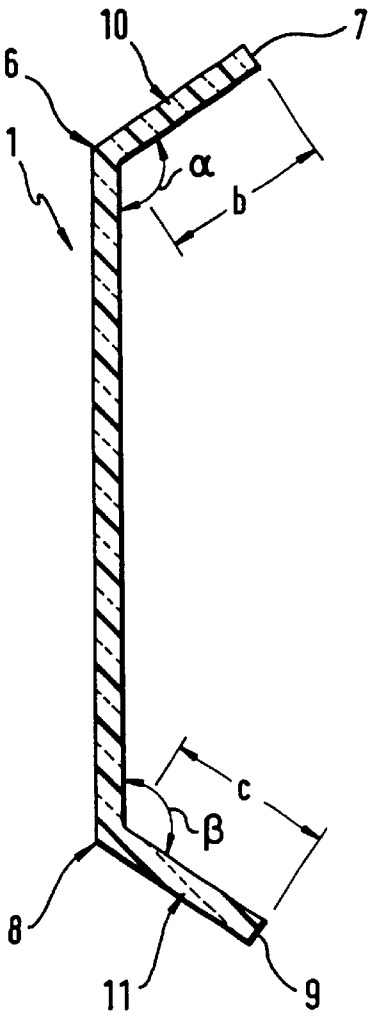
FIG. 4 shows a cross-sectional profile of a noise-protection wall-segment that exhibits kinks only in two regions close to the edges.

In FIG. 4 a cross-sectional profile of a noise-protection wall-segment is represented wherein the plastic sheet of the segment exhibits kinks only in two regions 6, 8. The stated regions 6, 8 are provided respectively in the vicinity of the left edge 7 and of the right edge 9 of the segment. The spacing b of the region 6 from the left edge 7 and the spacing c of the region 8 from the right edge 9 are of equal magnitude in this example, but this is not absolutely essential. By virtue of the two kinks in the two regions 6, 8 of the plastic sheet the latter comprises a left section 10, a right section 11 and a central section 12, within which no further curvature and no further kink is present. The angle $\alpha$ between the left section 10 and the central section 12 and the angle $\beta$ between the right section 11 and the central section 12 can each be freely chosen but lie advantageously between 180° and 75°.

Figure 5:
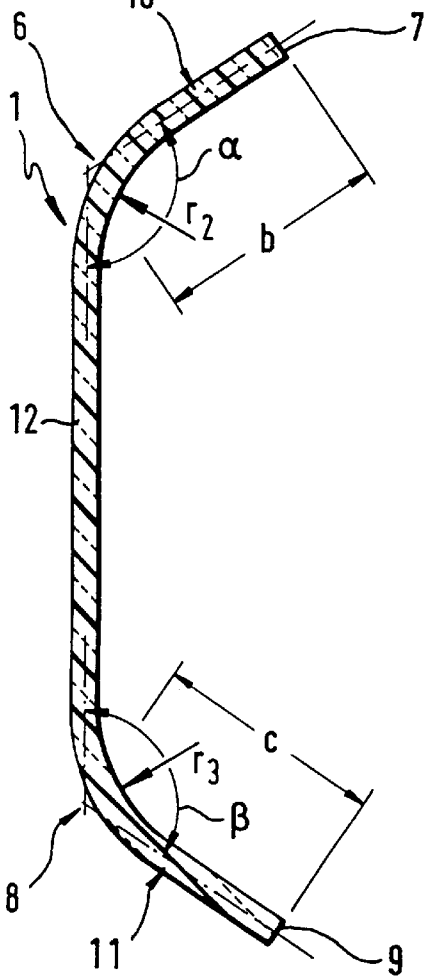
FIG. 5 is a cross-sectional profile of a noise-protection wall-segment that exhibits curvatures only in two regions close to the edges.

FIG. 5 shows a cross-sectional profile of a noise-protection wall-segment similar to that represented in FIG. 4. But, in contrast with the latter, the plastic sheet exhibits no kinks in the regions 6, 8 close to the edges but instead exhibits curvatures. With respect to the spacings b,c, the angles $\alpha$,$\beta$ and the nature of the sections 10, 11, 12, the statements made with respect to the cross-sectional profile in FIG. 4 apply.

Figure 6:
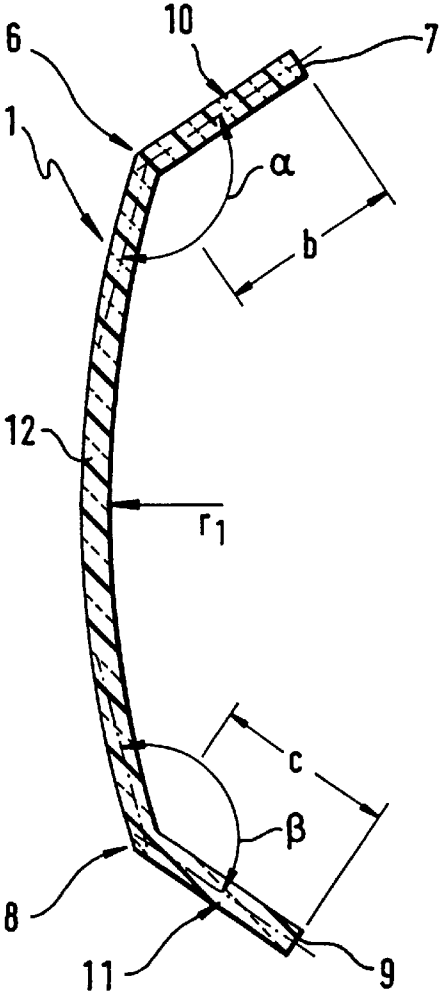
FIG. 6 is a cross-sectional profile of a noise-protection wall-segment that exhibits kinks in two regions close the edges, the central section also being vaulted.

FIG. 6 likewise shows a cross-sectional profile of a noise-protection wall-segment similar to that represented in FIG. 4. In contrast with the latter, the central section 12 of the plastic sheet also exhibits a vaulting that is characterized by a curvature of said central section. In FIG. 6 the curvature is the same over the entire length of the central section 12, i.e. it can be described by only one radius of curvature $r_1$. But FIG. 7 contains a design that provides for various curvatures within the central section 12. Similarly, the possibility is not excluded that some regions in the central section 12 exhibit no radius of curvature, since with these regions it is a question of non-curved, flat sheets. With respect to the angles $\alpha$ and $\beta$ it is to be emphasised that the latter can be chose freely and lie advantageously between 180° and 75°. With respect to the spacings b, c and the nature of the sections 10, 11, the statements made with respect to the cross-sectional profile in FIG. 4 apply.

Figure 7:
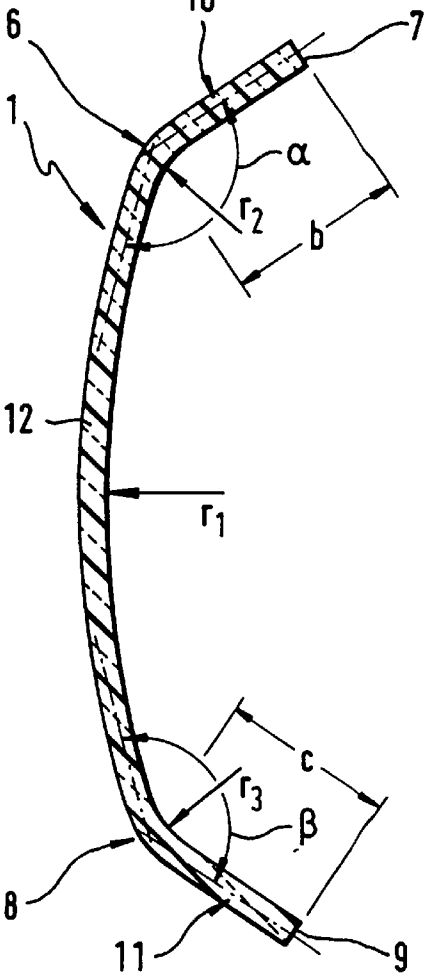
FIG. 7 illustrates a cross-sectional profile of the noise-protection wall-segment from FIG. 1.

FIG. 7 shows a cross-sectional profile of a noise-protection wall-segment similar to that represented in FIG. 6. In contrast with the latter, instead of the kinks in the regions 6,8 close to the edges, curvatures are provided which can be described respectively on the basis of the radii of curvature $r_2$ for the curvature in the region 6 and $r_3$ for the curvature in the region 8. Otherwise the statements made with respect to the cross-sectional profile in FIG. 6 apply.

Figure 8:
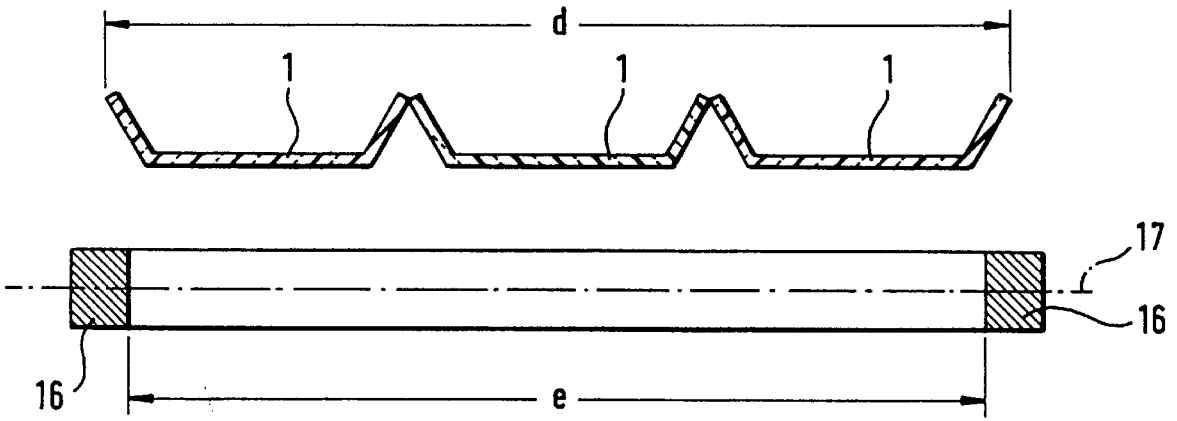
FIG. 8 shows three noise-protection wall-segments prior to integration into a noise-protection wall.

In FIG. 8 three noise-protection wall-segments 1 are represented in cross-section. The directly aligned, non-prestressed segments 1 have a total length d. The spacing e between the retaining posts 16 is smaller then the total length of the segments that are to be positioned along the installation line 17.

Figure 9A:
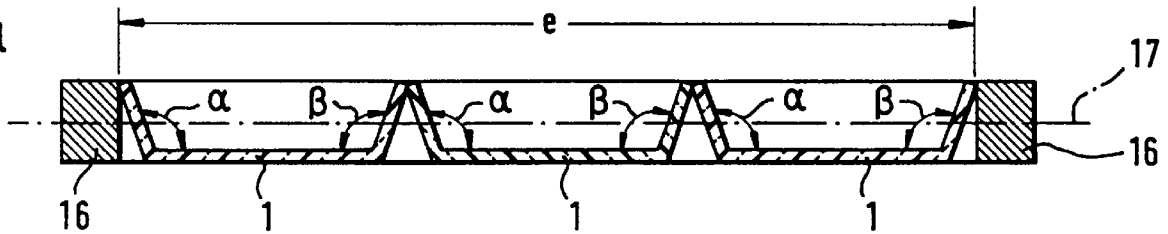
FIG. 9*a* shows three noise-protection wall-segments after integration into a noise-protection wall.
Figure 9B:
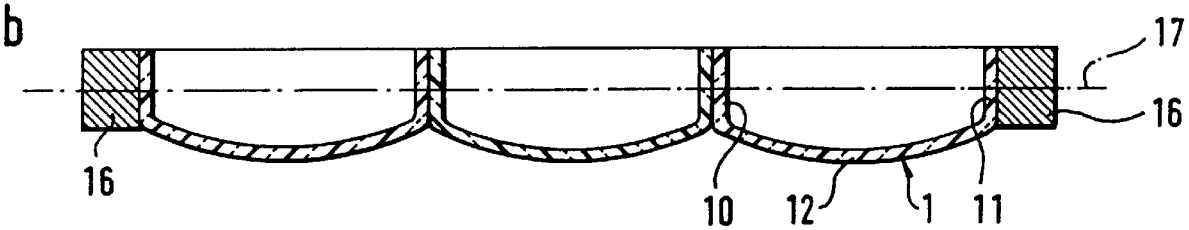
FIG. 9*b* shows three further noise-protection wall-segments after integration into a noise-protection wall according to the invention.

FIG. 9*a* shows the segments 1 which are employed, the total length d of which is reduced, as a result of prestressing, to the spacing e between the retaining posts 16. It is to be discerned that the segments 1 that have been compressed in this manner exhibit smaller angles $\alpha$ and $\beta$ than they did prior to fitting. In FIG. 9*b* an embodiment is represented in which a different embodiment of the basic element has been combined to form a noise-protection wall. An individual element exhibits three sections, of which the two sections 10, 11 close to the edges can be obtained by hot bending of the sheet (folding), whereas the middle or central section 12 is prestressed in the cold state and is consequently vaulted.

Figure 10:
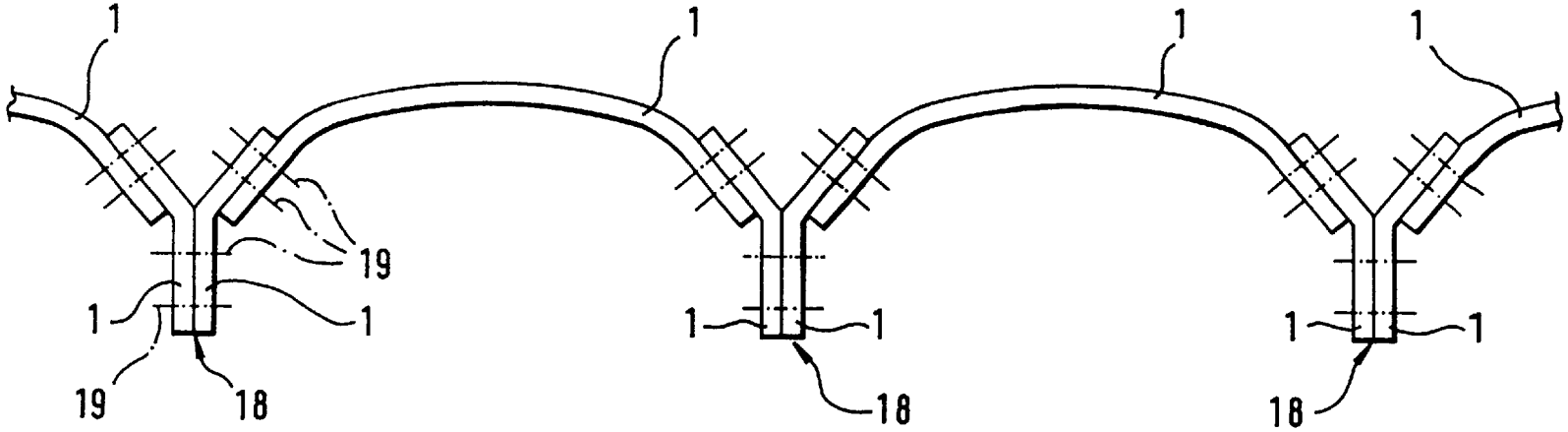
FIG. 10 is a detail of a top view of a special embodiment of the noise-protection wall according to the invention.

FIG. 10 shows a detail of a top view of a special embodiment of the noise-protection wall according to the invention. The noise-protection wall that is represented exhibits noise-protection wall-segments 1 which possess a cross-sectional profile shown in FIG. 7. Between the segments 1 there are provided retaining posts 18 that are composed of two noise-protection wall-segments 1 according to the invention which are connected by connecting means 19. However, the segments 1 of the retaining post 18 exhibit a kink only in one region, so that the segments 1 exhibit a cross-sectional profile with a flat V-shape. The two connected V-shaped segments 1 result in the Y-shaped appearance of the retaining post 18 in top view. The retaining posts 18 are anchored in the foundation (not shown), whereas the segments situated between the retaining posts 18 are fastened to the latter by connecting means 19.

Figure 11:
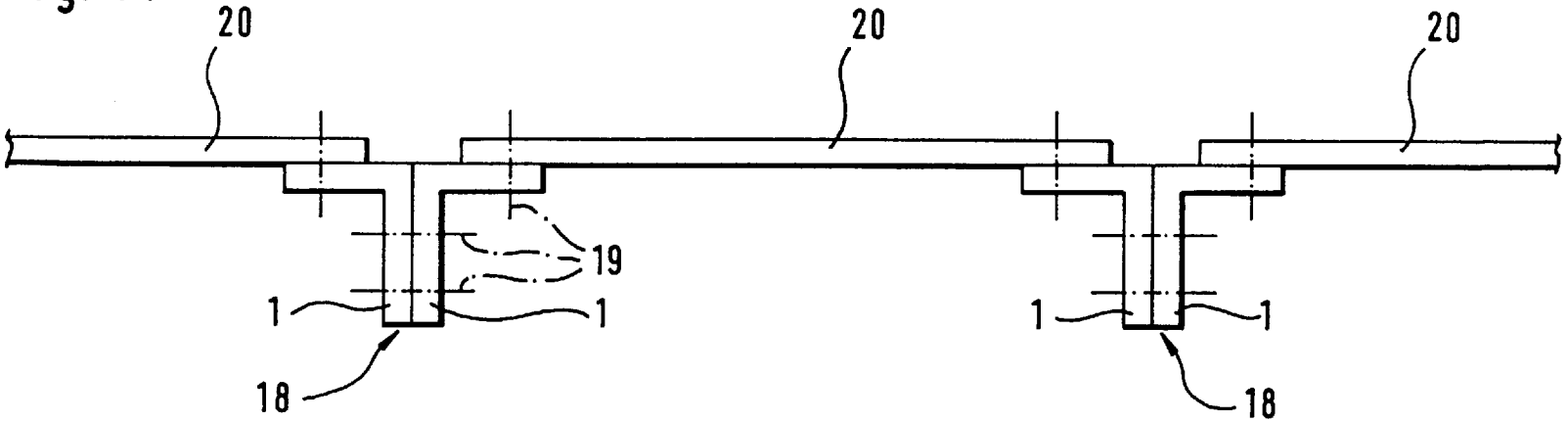
FIG. 11 is a detail of a top view of a special embodiment of the noise-protection wall according to the invention that also exhibits segments according to the state of the art.

FIG. 11 shows a detail of a top view of a special embodiment of the noise-protection wall according to the invention, which in contrast with the noise-protection wall represented in FIG. 10 also exhibits segments 20 according to the state of the art. In the case of the segments 20 according to the state of the art it is a question of flat sheets that are neither curved nor kinked. In the wall that is shown, the segments 20 are connected by connecting means 19 to retaining posts 18 which are provided in each instance between the stated segments 20. The retaining posts 18 consist, as already described in FIG. 10, of two V-shaped segments 1 which are connected by connecting means, though the individual segments 1 exhibit a V-shape with a right angle, so that the retaining posts 18 have a T-shape in top view. Although both of the embodiments of the noise-protection wall that are shown in FIGS. 10 and 11 exhibit retaining posts 18, the latter are transparent, as a result of which the overall impression of the transparent wall is not changed or is changed only insignificantly.

The following embodiment examples document the advantageous properties of the noise-protection elements according to the invention.

REFERENCE EXAMPLE 1

Production of a flat sheet made of synthetic material with embedded threads of synthetic material by means of the chamber process:

With a view to producing an acrylic-glass sheet with embedded threads of synthetic material, with the aid of a 20-mm peripheral seal a chamber was formed from two sheets of polished silicate glass having a size of 2×4 m. Monofilament polyamide threads having a diameter of 2 mm were clamped in this chamber parallel to one another, with a spacing of 30 mm in each case. After this, methyl-methacrylate syrup to which a radical-forming initiator had been added was poured into the chamber. The filled chamber was conveyed into a water bath, and the syrup was cured by supply of heat so as to form a sheet made of high-molecular polymethyl methacrylate. The chamber was polymerised lying flat. After removal from the mould this resulted in a cast acrylic-glass sheet having dimensions of approximately 2×4 m and a thickness of 20 mm with embedded polyamide threads and a substantially linear cross-sectional profile, which is designated in the following as sheet (1).

REFERENCE EXAMPLE 2

Production of a composite element with substantially linear cross-sectional profile by means of the Rostero process:

A chamber with a 20-mm-thick sealing strip is constructed in Rostero furnace. Polyamide cords were inserted into this chamber with a spacing of 30 mm. The diameter of the polyamide cords that were used amounted to 2 mm. This chamber which was produced in this way was charged with a methyl-methacrylate syrup containing radical-forming initiator. After charging, the chamber was evacuated, and polymerization was started by heating to 50° C. By virtue of the vertical arrangement of the polymerization chamber the polyamide cords were stretched parallel to the surface and embedded. After complete curing of the sheet the latter was removed from the mold. A sheet (2) was obtained having dimensions 2×4 m and having a thickness of 20 mm with nylon threads embedded in the matrix of the synthetic material.

REFERENCE EXAMPLE 3

Production of an acrylic-glass sheet exhibiting a substantially linear cross-sectional profile with embedded gratings made of synthetic material.

The procedure was as described in Example 1, the only difference being that, instead of the monofilament polyamide threads, use was made of a polyamide grating consisting of monofilament threads with a diameter of 2 mm and a mesh size of 50×50 mm. The sheet that was obtained exhibited a thickness of 20 mm and is designated as sheet (3)

EXAMPLES 4–6

Noise-protection segments (4), (5) and (6) according to the invention were produced from sheets (1) to (3).

Firstly, if desired, bores that may serve to receive fastening elements are provided at points in the respective sheet that are suitable for this purpose.

Subsequent to this, the sheets are deformed in the hot state. To this end, the sheet may be laid onto a roller table which supports the sheet over its full surface area. At a distance of approximately 0.5 m, relative to the two edges or borders, 2 m in length, of the respective sheet, the sheet is brought to a temperature above the glass temperature Tg of the material of the plastic matrix, for instance in a region of 10 cm in the form of a strip over the entire length of 2 m, by means of heating appliances, for example IR emitters, which are arranged above and below the sheet. The material which is then capable of being thermoplastically deformed in the aforementioned region is laid onto a prepared wooden mold that is bevelled on both sides of angles of approximately 74°. Under the influence of gravity the sheet is applied over its full surface area onto the wooden mold and is adapted to the geometry thereof. The heated zones are cooled under the constraint of the mould in such a way as to result in, as far as possible, low-stress or even stress-free bent-inward zones. In particular, slow cooling, i.e. a low rate of cooling, and/or tempering results in lower-stress sheets.

After the hot-bending step, the sheets that are obtained are jacked up once again. To this end, the sheets which are bent inward in the hot state are supported over the entire width of 2 m on both sides in such a way that the bent-inward sheet sections point upwards, away from the jacking-up arrangement. In this connection the jacked-up height of the central part of the sheet is favorably chosen so that the distance from sheet to ground in this region corresponds to the maximal vaulting aimed for in the course of cold bending. The sheet which is jacket up in such a way is subjected to a load centrally, giving rise to the requisite or maximum possible radius.

The sheet which has been bent in the cold state and which is under load is fixed by means of a clamping device and then fastened onto or to a prepared pedestal. By way of clamping device, use is made, for example, of a wire cable which is provided at both ends with shoes which are inserted above the now vertically upright, bevelled posts. The clamping device remains on the sheet until final assembly of the aligned noise-protection wall-segments or elements.

In accordance with the principle that has been described, sheets (4), (5) and (6) were produced that corresponded in their cross-sectional profiles to the embodiments according to FIGS. (3), (4) and (6), respectively.

The sheets obtained in this way were subjected to a pendulum-impact test. In principle, for the purpose of carrying out this test, a steel pear-shaped object weighing 400 kg is raised to a height of 1.6 metres, and the sheet is destroyed with it. The occurrence of free fragments that are no larger than 25 cm2 and that exhibit an angle of <15° serves by way of assessment criterion.

Implementation of the Pendulum Test

The segments that were formed with the transparent sheets according to the invention are fitted on three sides into a steel frame construction. At each corner of the sheet there is located, at a distance of 15 cm, a hole which serves to receive the catching safety device, i.e. use is made of a steel cable which is pulled through the four holes of the acrylic-glass sheet and fastened to the frame construction. This structure corresponds to the normal assembly of a transparent noise-protection wall. The distance from the acrylic-glass sheet to the energy-dissipating wall amounts to 1.24 m. In the normal case the pear-shaped object shatters the acrylic-glass sheet and is then braked by this wooden wall.

The acrylic-glass pane was destroyed with the "pear", which strikes the sheet from a height of 1.6 m. The pear-shaped object consists of two bluntly welded truncated spheres. The speed of impact amounted to 5.6 m per second; the energy amounted to 6.278 Joule. Measurement was carried out both at 20° C. and at −20° C.; in neither case did any free fragments arise. For the result of the fracture it is unimportant whether the deflection of the thread is in the direction of the demolishing body or turned away from it.

For all three sheets according to the invention, no free fragments were obtained in the fracture test, either at −20° C. or at +20° C.

LIST OF REFERENCE SYMBOLS

1 Noise-protection wall-segment
2 embedded threads
3 plastic sheet
4 perpendicular to the installation surface
5 installation surface
6 region in the vicinity of the left edge
7 left edge
8 region in the vicinity of the right edge
9 right edge
10 left section
11 right section
12 central section
13 lower edge of the noise-protection wall-segment
14 upper edge of the noise-protection wall-segment
15 middle of the cross-sectional profile
16 retaining post
17 installation line
18 retaining post consisting of two segments according to the invention
19 connecting means
20 noise-protection wall-segments according to the state of the art
a spacing between adjacent embedded threads
b spacing of the region in the vicinity of the left edge from the left edge
c spacing of the region in the vicinity of the right edge from the right edge
d total length of aligned, non-prestressed segments
e spacing between the retaining posts
$r_1$ radius of curvature of the curvature in the central section
$r_2$ radius of curvature of the curvature in the region in the vicinity of the left edge
$r_3$ radius of curvature of the curvature in the region in the vicinity of the right edge
$r_4$, $r_5$ . . . $r_i$ radii of curvature
$\alpha$ angle between the left section and the central section
$\beta$ angle between the right section and the central section

What is claimed is:

1. A noise-protection wall-segment, which comprises:

first and second transparent sheets;

a fixing device for fixing the sheets in place, wherein the sheets, relative to an arrangement in an assembled noise-protection wall, are each curved, respectively, around vertical lines so as to extend out of the plane of the wall defined by the noise-protection wall; and a support for the sheets wherein the sheets are each shaped in such a manner that loads due to wind pressure thereon are conducted away into said support without the use of posts, support members or load-bearing members arranged between said first and second sheets.

2. A segment according to claim 1, wherein the sheet has a sheet surface shaped around an axis perpendicular to the installation surface of the segment in such a manner that a portion of the cross-sectional profile of the sheet surface has one of radii of curvature, an angle between sections, and one or more radii of curvature over the entire contour of said cross-sectional profile.

3. A segment according to claim 2, wherein the cross-sectional profile has only one radius of curvature over the entire contour thereof.

4. A segment according to claim 2, wherein a cross-sectional profile of said sheet has one of a curvature and a kink only in two regions thereof adjacent opposite edges of the sheet, so that the cross-sectional profile comprises, respectively, a first and a second section and a central section positioned therebetween.

5. A segment according to claim 4, wherein the first section and second section and the central section of each form an angle between 90 degrees and less than 180 degrees with the central section.

6. A segment according to claim 2, wherein a cross-sectional profile in regions adjacent to first and second edges of the sheet exhibits one of a curvature and a kink, so that the cross-sectional profile comprise a first section and a second section and a central section, wherein the central section has one or more radii of curvature.

7. A segment according to claim 6, wherein between the first and second section and the central section of the cross-sectional profile an angle of between 45 degrees and less than 180 degrees exists.

8. A segment according to claims 6 or 7, wherein a central section of the cross-sectional profile has only a single radius of curvature over the entire contour.

9. A segment according to claim 1, wherein the radius of curvature of the central section of the cross-sectional profile of an acrylic-glass sheet lies between $6\times10^3$ and $12\times10^3$ and has a thickness of at least 20 mm.

10. A segment according to claim 1, wherein the transparent sheet comprises one of organic glass and inorganic glass.

11. A segment according to claim 10, wherein the transparent sheet comprises a plastic.

12. A segment according to claim 11, wherein the plastic sheet h as a plurality of embedded monofilament threads.

13. A segment according to claim 12, wherein the threads comprise a polyafide.

14. A segment according to claim 13, wherein the polyamide threads extend perpendicularly.

15. A segment according to claim 1, wherein the fixing device comprise concrete moldings having receptacles for fastening of the sheets with screws and rivets.

16. A segment according to claim 15, wherein the concrete pedestal of the segment comprises a polymer concrete.

17. A segment according to claim 14, wherein the transparent sheet is clamped into the concrete pedestal and fixed thereto.

18. A noise-protection wall having at least one noise-protection wall segment, which comprises:

first and second transparent sheets;

a fixing device for fixing the sheets in place, wherein the sheets, relative to an arrangement in an assembled noise-protection wall, are each curved, respectively, around vertical lines so as to extend out of the plane of the wall defined by the noise-protection wall; and a support for the sheets wherein the sheets are each shaped in such a manner that loads due to wind pressure thereon are transferred to said support without the use of posts, support members or load-bearing members arranged between said first and second sheets.

19. A wall according to claim 18, wherein the sheets are arranged substantially side by side without fastening members being provided therebetween.

20. A wall according to claims 18 or 19, wherein said sheets are constructed along an installation line in such a manner that an edge of the first sheet borders an edge of the second sheet, and one of retaining posts and load-bearing members are provided at at least one of an end portion and a beginning portion of the installation line.

21. A wall according to claim 18, wherein said at least one segment comprises two segments interconnected fastening members in such a manner that said first and second sheets of each of said segments form a retaining post which stands between adjacent segments of the noise-protection wall and is connected to said segments via fastening members.

22. A wall according to claim 21, wherein the segments which form the retaining post each have a cross-sectional profile member having one of a curvature and a kink in only one region thereof, such that the cross-sectional profile comprises a first and second section.

23. A wall according to claim 22, wherein the first and second sections form an angle therebetween of between 90 degrees and less than 180 degrees.

24. A wall according to claim 22, wherein an angle found between the first and the second sections is substantially 90 degrees and wherein the segments between the retaining posts comprise substantially flat sheets.

25. A process for producing a noise-protection wall-segment which comprises:

shaping a first and second transparent sheet in such a manner that the sheets, relative to an arrangement thereof in an assembled noise-protection wall, are one of vaulted and folded around vertical lines, respectively, located out of the plane of the noise-protection wall, and positioning the transparent sheets on one of a foundation and a pedestal side by using one of fixing and clamping mechanism without the use of posts, supporting members or load bearing members.

26. A process according to claim 25, which comprises shaping the transparent plastic sheet from acrylic glass by bending the sheet inward in a hot state at two sections of the sheet at the edge at temperatures above a temperature Tg of the acrylic glass and pressing the central section in the cold state at temperatures below the temperature Tg.

27. A process according to claim 26, wherein the acrylic-glass sheet is substantially 20 mm thick, 2 m high and 4 m wide and is bent in the hot state at approximately 0.5 m and at approximately 3.5 m, related to the width of the sheet, over the entire height of the sheet in the same direction at an angle of substantially 74°, a central section having a width of substantially 3 m is obtained, and the central section is bent inward in the cold state with a radius of curvature of substantially 600 mm, the resulting vaulting being fixed with clamping tools, and wherein the sheet is connected to a pedestal made of concrete.

28. A process for producing a noise-protection wall in accordance with claim 25, which confer lining up a plurality of prestressed segments formed of said sheets in a side by side manner to form the wall, reciprocally supporting said segments in a substantially lateral manner and supporting said segments against retaining posts located at one of ends of the wall and at intervals.

* * * * *